US011067082B2

(12) United States Patent
Kikuchi et al.

(10) Patent No.: US 11,067,082 B2
(45) Date of Patent: Jul. 20, 2021

(54) SCREW COMPRESSOR

(71) Applicant: Kobe Steel, Ltd., Hyogo (JP)

(72) Inventors: Masahiro Kikuchi, Kobe (JP); Kazuki Tsugihashi, Kobe (JP); Yoshio Yano, Kobe (JP); Toshiyuki Miyatake, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 273 days.

(21) Appl. No.: 16/060,964

(22) PCT Filed: Nov. 15, 2016

(86) PCT No.: PCT/JP2016/083845
§ 371 (c)(1),
(2) Date: Jun. 11, 2018

(87) PCT Pub. No.: WO2017/110311
PCT Pub. Date: Jun. 29, 2017

(65) Prior Publication Data

US 2018/0363650 A1 Dec. 20, 2018

(30) Foreign Application Priority Data

Dec. 25, 2015 (JP) ..... JP2015-254473

(51) Int. Cl.
*F04C 18/16* (2006.01)
*F04C 29/00* (2006.01)
*F04C 23/00* (2006.01)

(52) U.S. Cl.
CPC ..... *F04C 18/16* (2013.01); *F04C 23/003* (2013.01); *F04C 29/005* (2013.01);
(Continued)

(58) Field of Classification Search
CPC ..... F04C 18/16–18; F04C 23/001–003; F04C 29/005; F04C 2240/30;
(Continued)

(56) References Cited

U.S. PATENT DOCUMENTS 5,785,149 A 7/1998 Luyts
6,073,517 A * 6/2000 Pauwels ..... F04C 29/06 74/606 R
(Continued)

FOREIGN PATENT DOCUMENTS

CN 2011-03675 Y 8/2008
CN 103443466 A 12/2013
(Continued)

OTHER PUBLICATIONS

International Preliminary Report on Patentability issued in corresponding International Application No. PCT/JP2016/083845; dated Jul. 5, 2018.
(Continued)

*Primary Examiner* — Alexander B Comley
(74) *Attorney, Agent, or Firm* — Studebaker & Brackett PC

(57) ABSTRACT

A screw compressor 2 includes a compressor main body 4, a motor 8, and a gearbox 10. The compressor main body 4 includes screw rotors 5*c*, 5*d*, 6*c*, and 6*d*, rotor casings 5*e* and 6*e* accommodating therein the screw rotors 5*c*, 5*d*, 6*c*, and 6*d*, and main body casings 5*a* and 6*a* accommodating therein the rotor casings 5*e* and 6*e*, the main body casings being provided with first flanges 5*b* and 6*b* on respective ends thereof. The motor 8 drives the screw rotors 5*c*, 5*d*, 6*c*, and 6*d* via gears 10*f* and 10*g*. The gearbox 10 has an attachment surface Son which the first flange 6*b* to the main body casings 5*a* and 6*a* is attached, accommodates therein the gears 10*f* and 10*g*, and has a substantially rectangular
(Continued)

shape. In a state where the compressor main body 4 is attached to the gearbox 10, a part of the first flange 6*b* extends to an outside of the attachment surface S, and projection regions of the rotor casings 5*e* and 6*e* onto the attachment surface S exist within the attachment surface S. In this way, vibrations of the screw compressor 2 can be reduced.

12 Claims, 12 Drawing Sheets

(52) U.S. Cl.
CPC ..... *F04C 23/001* (2013.01); *F04C 2240/30* (2013.01); *F04C 2270/12* (2013.01)

(58) Field of Classification Search
CPC ..... F04C 2270/12–125; F04C 2270/13–135; F04C 2210/1005; F01C 1/16–18; F01C 21/007
USPC ..... 417/410.4; 418/9, 201.1–203, 206.1, 418/206.2
See application file for complete search history.

(56) References Cited

U.S. PATENT DOCUMENTS

| | | | | |
|---|---|---|---|---|
| 2006/0280626 | A1* | 12/2006 | Nishimura | F04C 18/16 417/410.4 |
| 2009/0277215 | A1* | 11/2009 | Tsuboi | F04C 18/16 62/498 |
| 2013/0305723 | A1 | 11/2013 | Haghjoo | |
| 2017/0074266 | A1 | 3/2017 | Fukushima et al. | |

FOREIGN PATENT DOCUMENTS

| | | | | |
|---|---|---|---|---|
| JP | 61234290 | A * | 10/1986 | F04C 23/001 |
| JP | S61-234290 | A | 10/1986 | |
| JP | H09-126169 | A | 5/1997 | |
| JP | 2006-342742 | A | 12/2006 | |
| JP | 2015-169180 | A | 9/2015 | |

OTHER PUBLICATIONS

International Search Report issued in PCT/JP2016/083845; dated Feb. 14, 2017.

* cited by examiner

SCREW COMPRESSOR

CROSS-REFERENCE TO RELATED APPLICATIONS

This is a national phase application in the United States of International Patent Application No. PCT/JP2016/083845 with an international filing date of Nov. 15, 2016, which claims priority of Japanese Patent Application No. 2015-254473 filed on Dec. 25, 2015 the contents of which are incorporated herein by reference.

TECHNICAL FIELD

The present invention relates to a screw compressor.

BACKGROUND ART

Screw compressors are well known to be used as a supply source of high-pressure air in factories and the like. To efficiently produce compressed air, the screw compressors are often driven via speed increasers. Such a screw compressor includes a motor, a gearbox, and a compressor main body. Power from the motor is increased in speed via gears in the gearbox and transferred to the compressor main body. The transmitted power rotates a pair of male and female screw rotors within the compressor main body to compress a fluid such as air.

For example, JP 9-126169 A discloses a two-stage screw compressor in which a substantially rectangular gearbox and a compressor main body (a low-pressure stage compressor main body and a high-pressure stage compressor main body) are connected together.

DISCLOSURE OF THE INVENTION

Problems to be Solved by the Invention

When a compressor main body is attached to a substantially rectangular gearbox in the same manner as the screw compressor mentioned in JP 9-126169 A, an attachment portion therebetween vibrates in the thickness direction of the gearbox along with the rotation of the screw rotors. Normally, in such a vibration mode, since the gearbox has a high natural frequency with respect to the rotational speed of the compressor main body, the compressor main body or the gearbox do not resonate with each other. However, when the natural frequency of the gearbox in the vibration mode decreases due to factors, such as an increase in the mass and a decrease in the rigidity of the gearbox, the compressor main body and the gearbox could resonate. Once the resonance occurs, the durability of the screw compressor is adversely affected.

It is an object of the present invention to reduce vibration of a screw compressor without any additional component.

Means for Solving the Problems

The present invention provides a screw compressor including: a compressor main body including screw rotors, a rotor casing accommodating therein the screw rotors, and a main body casing accommodating therein the rotor casing, the main body casing having a first flange provided on an end thereof; an electric motor for driving the screw rotors via a gear; and a substantially rectangular gearbox accommodating therein the gear, having an attachment surface on which attaching the first flange of the main body casing is attached, wherein in a state where the compressor main body is attached to the gearbox, a part of the first flange extends to an outside of the attachment surface, and a projection region of the rotor casing onto the attachment surface exists within the attachment surface.

With this configuration, in a vibration mode in which an attachment portion of the compressor main body vibrates in the thickness direction of the gearbox, the natural frequency of the gearbox with the compressor main body attached in the vibration mode can be made higher than the rotational speed of the compressor main body. Thus, the resonance between the compressor main body and the gearbox can be suppressed without any additional component to reduce vibrations of the screw compressor. Specifically, the tip end (upper) part of the gearbox is removed to extend a part of the first flange to the outside of the attachment surface, thereby decreasing the mass of the tip end part of the gearbox, thus increasing the natural frequency of the gearbox with the compressor main body attached in the vibration mode. However, in the configuration in which a part of the first flange is extended to the outside of the attachment surface of the gearbox, if an extension amount of the part is set extremely large in order to decrease the mass of the tip end part of the gearbox, the rigidity of a connection portion between the compressor main body and the gearbox is reduced, which could increase vibrations. Thus, the extension amount is limited so that the projection region of the rotor casing onto the attachment surface exists within the attachment surface, whereby the rigidity of the connection portion between the compressor main body and the gearbox is maintained at a certain level or more. In particular, since the first flange is integrated with the gearbox in the above-mentioned range of the extension amount, the effect of increasing the rigidity can be obtained as if the thickness of the first flange were increased. Therefore, the rigidity of the screw compressor does not need to be increased only by the main body casing. Here, the term projection region means a region projected in the direction vertical to the attachment surface (including an extended surface).

Preferably, the compressor main body includes a low-pressure stage compressor main body and a high-pressure stage compressor main body for further compressing gas compressed by the low-pressure stage compressor main body, and a part of a projection region of a side wall of the main body casing in the low-pressure stage compressor main body onto the attachment surface exists outside the attachment surface.

Since the low-pressure stage compressor main body has a larger mass than the high-pressure stage compressor main body, in the gearbox, the natural frequency of the attachment portion of the low-pressure stage compressor main body is lower than the natural frequency of the attachment portion of the high-pressure stage compressor main body. Because of this, the low-pressure stage compressor main body is more likely to resonate than the high-pressure stage compressor main body. Therefore, in the attachment portion of the low-pressure stage compressor main body, increasing the natural frequency by decreasing the mass of the tip end part of the gearbox is effective for suppressing the resonance between the compressor main body and the gearbox to reduce vibrations. The part of the projection region of the side wall of the main body casing onto the attachment surface exists outside the attachment surface, so that the mass of the tip end part of the gearbox can be decreased to increase the natural frequency thereof the gearbox in the vibration mode.

The compressor main body is preferably disposed at the gearbox such that a strong axis direction of the main body casing against is within a range of −45 degrees to +45 degrees relative to a weak axis direction of the gearbox against the vibration.

By arranging the main body casing with respect to the gearbox such that the strong axis direction of the main body casing overlaps with the weak axis direction of the gearbox within the range of −45 degrees to +45 degrees, the rigidity of the main body casing and the gearbox as an integrated structure can be effectively increased. Here, the strong axis and the weak axis are defined as directions perpendicular to the thickness direction of the gearbox at which vibrations should be considered. The strong axis is the main axis in which the area moment of inertia is at the maximum, and the weak axis is the main axis in which the area moment of inertia is at the minimum. At this time, the direction of the strong axis corresponds to the direction in which vibration is more likely to occur, whereas the direction of the weak axis corresponds to the direction in which vibration is less likely to occur. That is, the main body casing is disposed at the gearbox such that the direction in which the main body casing is less likely to vibrate overlaps with the direction in which the gearbox is more likely to vibrate, thereby making it possible to reduce vibrations of the integrated structure.

The gearbox is preferably provided with a stiffening rib extended in a longitudinal direction thereof within the attachment surface.

By providing the stiffening rib in the longitudinal direction of the gearbox, the rigidity of the gearbox in the vibration mode can be effectively enhanced.

The gearbox is preferably provided with an embedded oil pipe extended in a longitudinal direction thereof within the attachment surface.

With this configuration, like the above-mentioned stiffening rib, the embedded oil pipe can be utilized for stiffening. Further, the oil pipe can be used to supply the lubricating and cooling oil to each site required in the compressor main body. Especially, the embedded oil pipe eliminates the need to perform a piping operation at the time of assembly, and makes it possible to suppress oil leakage at connection locations of the piping.

Preferably, the gear box has upper side both corners to which the compressor main body is connected so as to be within the attachment surface, and lower both corners with second flanges.

By providing the second flanges on the attachment surface of the gearbox, the rigidity of the gearbox for the vibration mode can be further improved.

The gearbox is preferably connected to a separate structure at the second flanges.

By connecting the gearbox to a structure, such as a cooler, the rigidity of the gearbox for the vibration mode can be further improved. The structure, such as the cooler, normally has so extremely high rigidity so that when the structure and the gearbox are connected and integrated together, the attachment part of the structure acts as the fixed end of vibrations. This corresponds to an arrangement that shortens the length from a root (lower) part of the gearbox to the tip end (upper) part thereof, which can increase the natural frequency thereof in the vibration mode.

Effects of the Invention

According to the present invention, in the vibration mode in which the gearbox vibrates in the thickness direction, the natural frequency thereof in the vibration mode can be made higher than the rotational speed of the compressor main body, so that the resonance between the compressor main body and the gearbox can be suppressed to reduce vibrations of the screw compressor without any additional component.

MODE FOR CARRYING OUT THE INVENTION

Embodiments of the present invention will be described below with reference to the accompanying drawings.

First Embodiment

Figure 1:
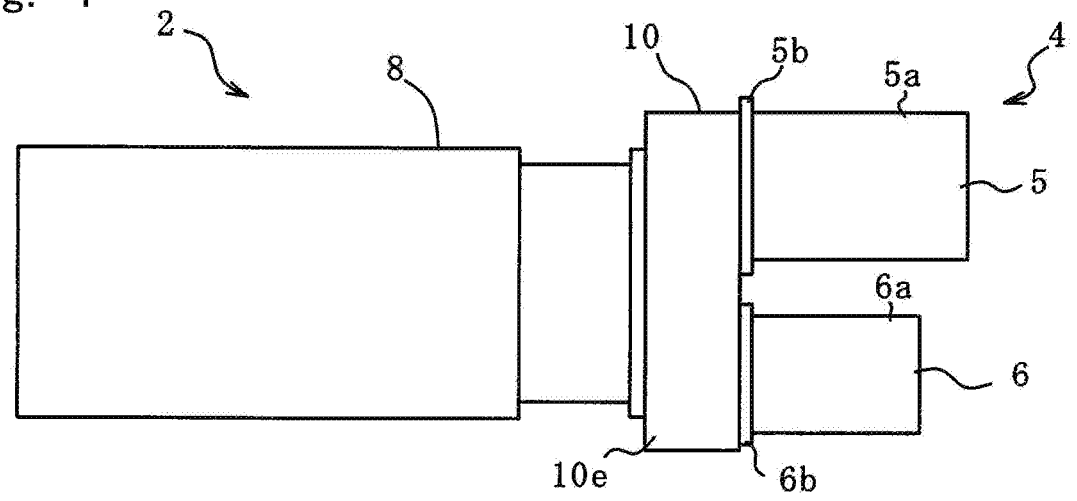
FIG. 1 is a plan view of a screw compressor according to a first embodiment of the present invention.
Figure 2:
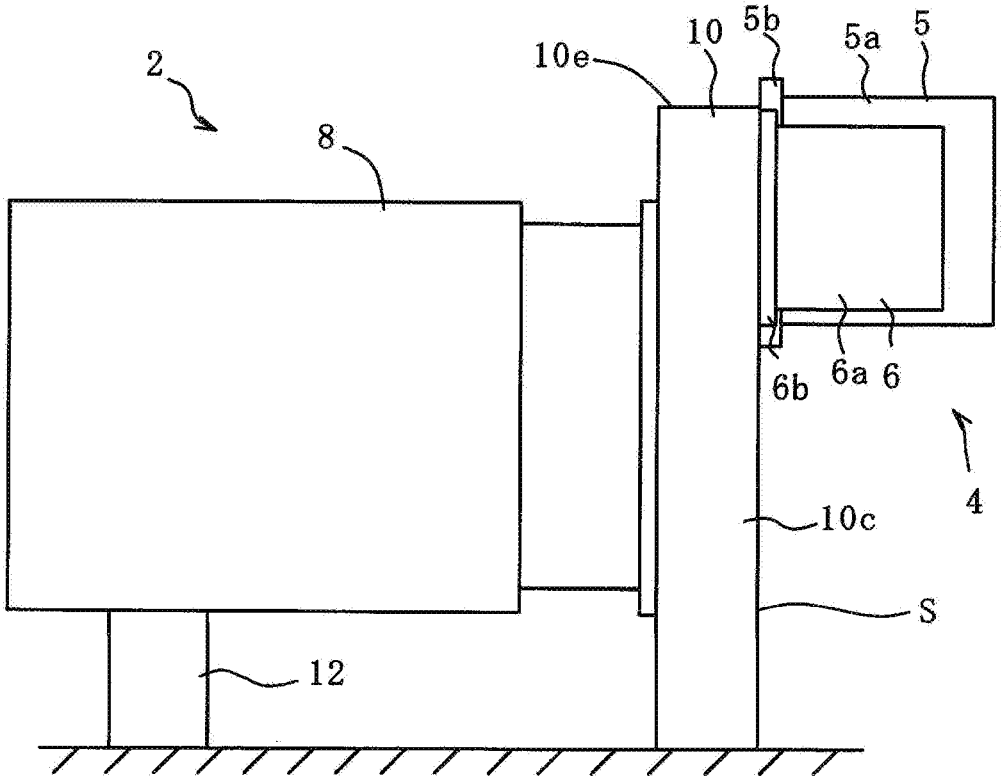
FIG. 2 is a side view of the screw compressor shown in FIG. 1.

As shown in FIGS. 1 and 2, a screw compressor 2 of the present embodiment includes a compressor main body 4, a motor (electric motor) 8, and a gearbox 10. The gearbox 10 is installed on a floor surface and disposed between the motor 8 and the compressor main body 4. The motor 8 and the compressor main body 4 are attached to the gearbox 10. The motor 8 is installed at the floor surface via a support member 12. The compressor main body 4 is supported by the gearbox 10.

Figure 3:
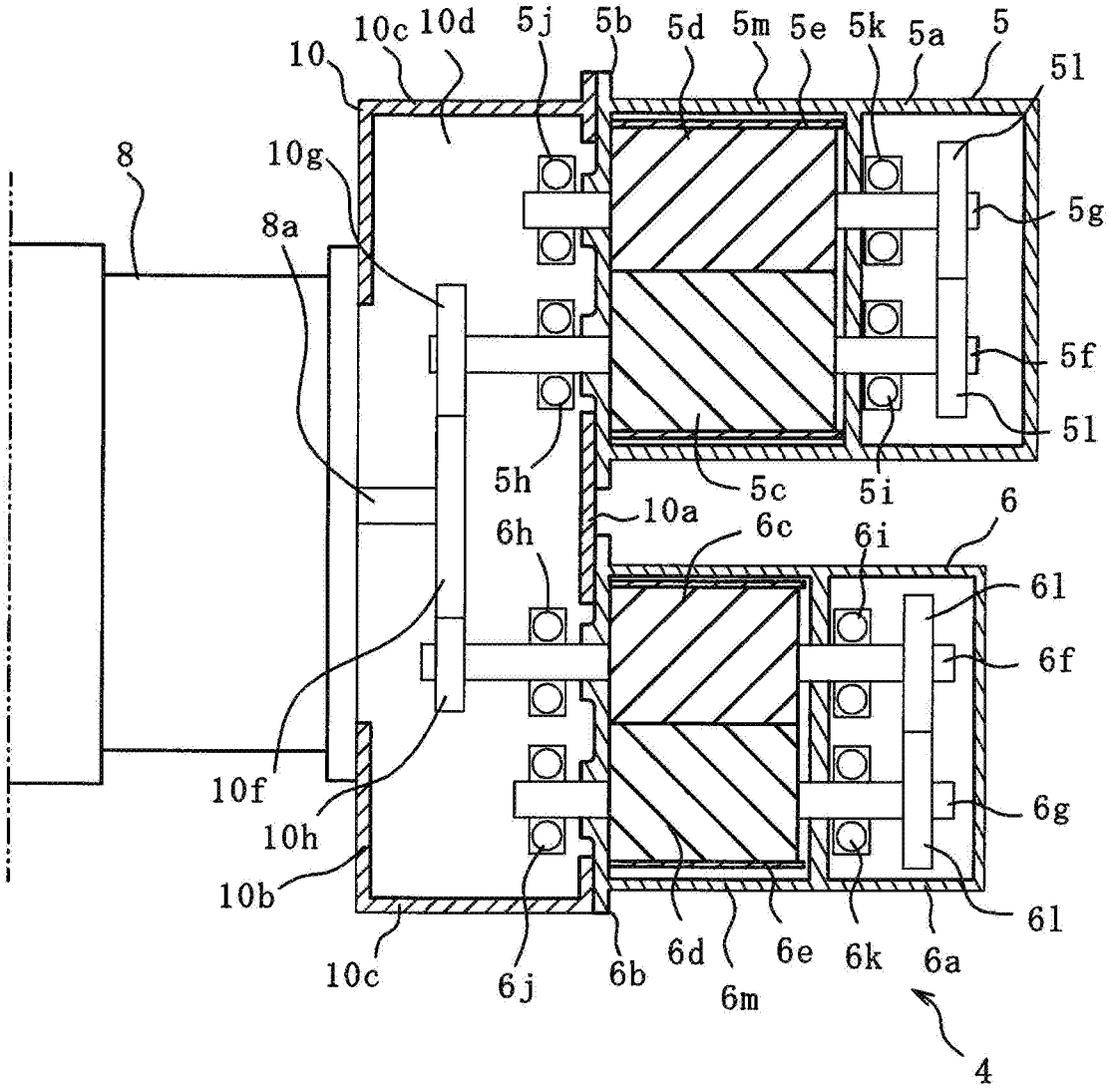
FIG. 3 is a schematic cross-sectional view of the screw compressor shown in FIG. 2.

As also shown in FIG. 3, the compressor main body 4 is of a two-stage type and includes a low-pressure stage compressor main body 5 and a high-pressure stage compressor main body 6. The low-pressure stage compressor main body 5 and the high-pressure stage compressor main body 6 include main body casings 5*a* and 6*a*, respectively. First flanges 5*b* and 6*b* are provided as parts of the main body casings 5*a* and 6*a* at the ends of the main body casings 5*a* and 6*a*, respectively. The compressor main body 4 is connected to the gearbox 10 by bolting via the first flanges 5*b* and 6*b*.

A pair of male and female screw rotors 5*c* and 5*d* and a pair of male and female screw rotors 6*c* and 6*d* are disposed within the main body casings 5*a* and 6*a*, respectively, in a state of being accommodated in the rotor casings 5*e* and 6*e*. The screw rotors 5*c*, 5*d*, 6*c*, and 6*d* are integrated with rotating shafts 5*f*, 5*g*, 6*f*, and 6*g* that extend through the centers of the screw rotors 5*c*, 5*d*, 6*c*, and 6*d*, respectively. The rotating shafts 5*f*, 5*g*, 6*f* and 6*g* are pivotally supported rotatably on bearings 5*h* to 5*k* and 6*h* to 6*k*, respectively. A timing gear 5*l* is attached to one end of each of the rotating shafts 5*f* and 5*g*, and a timing gear 6*l* is attached to one end of each of the rotating shafts 6*f* and 6*g*. Through the timing gears 5*l* and 6*l*, the male rotors 5*c* and 6*c* and the female rotors 5*d* and 6*d* are rotatable without coming into direct contact with each other. The other ends of the rotating shafts 5*g* and 6*g* of the female rotors 5*d* and 6*d* extend into the gearbox 10 through holes provided in the front plate 10*a* of the gearbox 10. Pinion gears 10*g* and 10*h* are attached to the other ends of the rotating shafts 5*f* and 6*f* of the male rotors 5*c* and 6*c*, respectively.

The gearbox 10 is a box closed by the front plate 10*a*, a rear plate 10*b*, two side plates 10*c* and 10*c*, a bottom plate 10*d*, and a top plate 10*e*. The front plate 10*a* and the rear plate 10*b* are substantially rectangular, that is, the gearbox 10 has a substantially rectangular shape in the front view. By forming the gearbox 10 in the substantially rectangular shape, the size and cost of the gearbox 10 can be reduced, compared to a case where the gearbox 10 having a circular shape is connected to the compressor main body 4. A bull gear 10*f* and the pinion gears 10*g* and 10*h* are accommodated in the gearbox 10. In the gearbox 10, the pinion gears 10*g* and 10*h* are meshed with the bull gear 10*f* attached to an end of a motor rotary shaft 8*a*. The motor rotary shaft 8*a* extends into the gearbox 10 through a hole formed in the rear plate 10*b* of the gearbox 10. The motor rotary shaft 8*a* is pivotally supported rotatably. In the present embodiment, the outer surface of the front plate 10*a* serves as an attachment surface S of the compressor main body 4.

Figure 4:
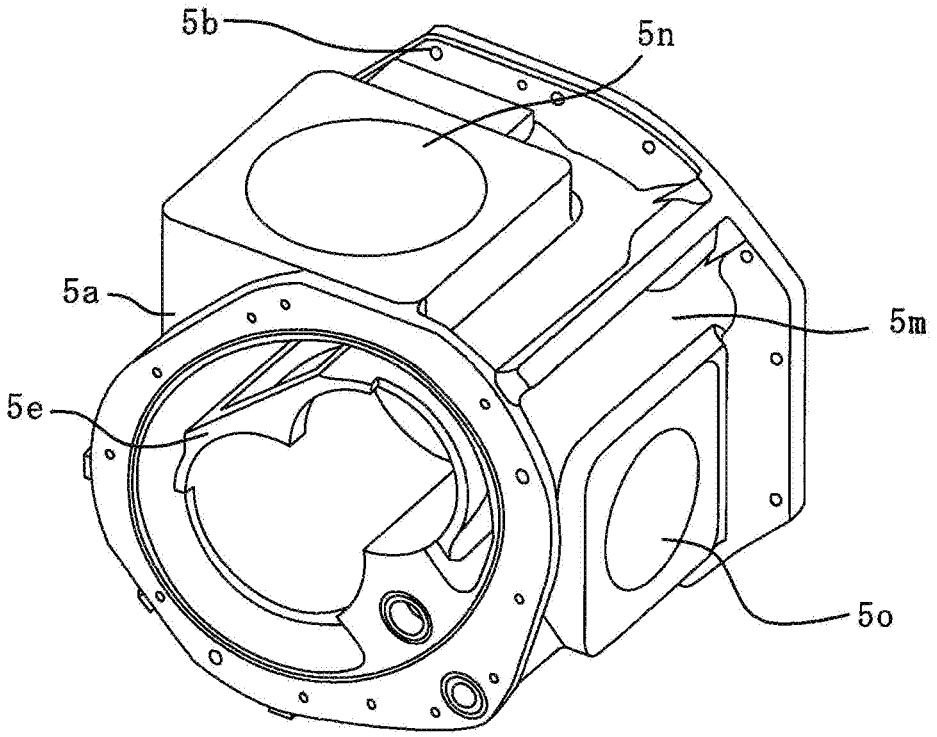
FIG. 4 is a perspective view of a main body casing and a rotor casing of a low-pressure stage compressor main body shown in FIG. 1.
Figure 5:
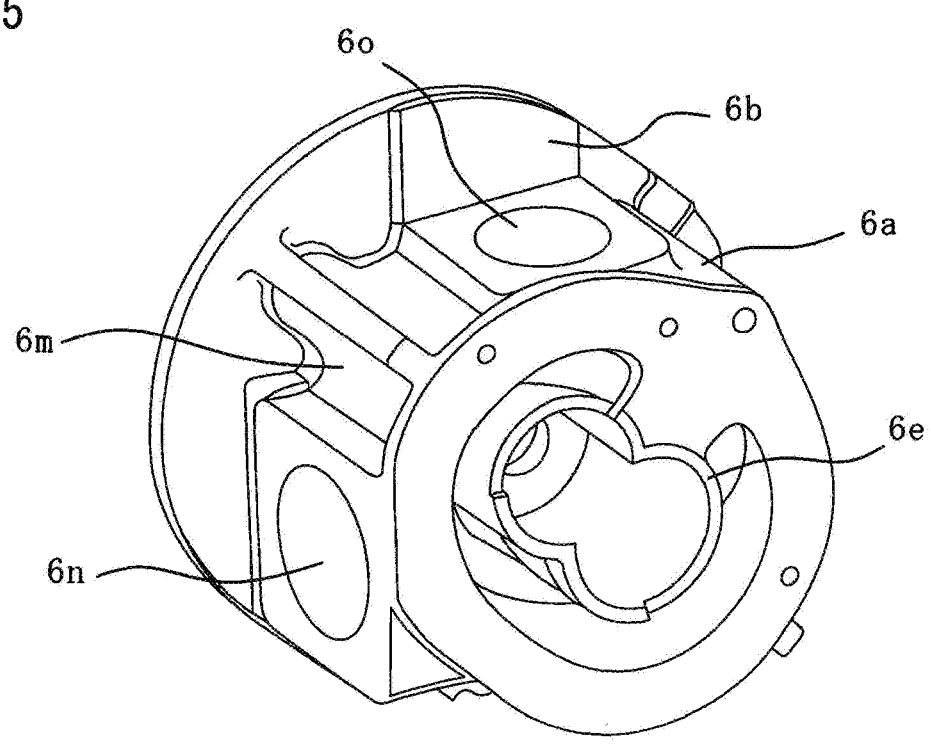
FIG. 5 is a perspective view of a main body casing and a rotor casing of a high-pressure stage compressor main body shown in FIG. 1.

As shown in FIGS. 4 and 5, the low-pressure stage compressor main body 5 and the high-pressure stage compressor main body 6 include the main body casings 5*a* and 6*a* that accommodate therein rotor casings 5*e* and 6*e*, respectively. The first flanges 5*b* and 6*b* for attachment to the gearbox 10 are provided at the ends of the main body casings 5*a* and 6*a*. The first flanges 5*b* and 6*b* have substantially the same thickness as side walls 5*m* and 6*m*, and extend outward in the radial direction from the respective side walls 5*m* and 6*m* of the main body casings 5*a* and 6*a*. The low-pressure stage compressor main body 5 draws gas from an intake port 5*n* into the rotor casing 5*e*, compresses the gas by the screw rotors 5*c* and 5*d* (see FIG. 3), and then discharges the compressed gas from a discharge port 5*o* to the outside of the main body casing 5*a*. The high-pressure stage compressor main body 6 draws gas from an intake port 6*n* into the rotor casing 6*e*, compresses the gas by the screw rotors 6*c* and 6*d* (see FIG. 3), and then discharges the compressed gas from a discharge port 6*o* to the outside of the main body casing 6*a*. The discharge port 5*o* of the low-pressure stage compressor main body 5 and the intake port 6*n* of the high-pressure stage compressor main body 6 are fluidly connected together by piping (not shown). The gas drawn and compressed in the low-pressure stage compressor main body 5 is supplied to the high-pressure stage compressor main body 6 and further compressed therein to be then discharged therefrom.

Figure 6:
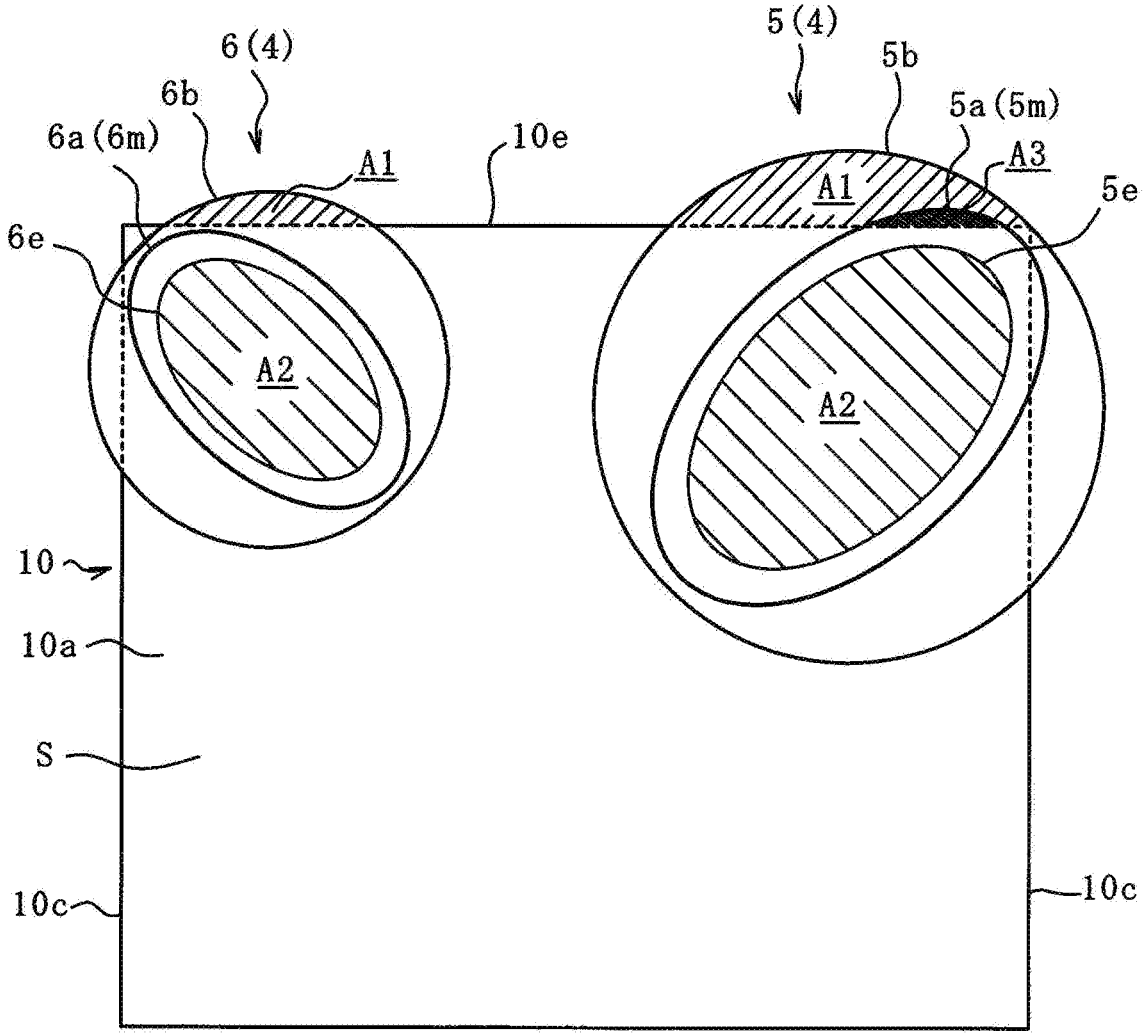
FIG. 6 is a schematic view showing the positional relationship between the compressor main body and a gearbox.

Referring to FIG. 6, an attachment arrangement of the compressor main body 4 onto the gearbox 10 will be described below. The compressor main body 4 (the low-pressure stage compressor main body 5 and the high-pressure stage compressor main body 6) is attached in the vicinity of both corners on the upper side of the gearbox 10 in the front view. In a state where the compressor main body 4 is attached to the gearbox 10, parts of the first flanges 5*b* and 6*b* are extended upward to the outside of the attachment surface S (hatched region A1). A projection region of each of the rotor casings 5*e* and 6*e* onto the attachment surface S exists within the attachment surface S (hatched region A2). Here, the term projection region means a region projected in the direction vertical to the attachment surface S (including an extended surface).

Vibration of the compressor main body 4 occurs at a frequency corresponding to the rotational speeds of the screw rotors 5*c*, 5*d*, 6*c*, and 6*d*. In a case where the rotational speeds of the screw rotors are inverter controlled for energy saving, when the rotational speed changes depending on a load, the compressor main body 4 and the gearbox 10 resonate with each other if the natural frequency of the compressor main body is identical to the natural frequency of the gearbox 10, leading to increased vibrations in some cases. In the attachment arrangement shown in FIGS. 1 and 2, an attachment portion of the compressor main body 4 tends to excite the vibration mode in which vibrations propagate in the thickness direction of the gearbox 10. Thus, the resonance in the vibration mode needs to be suppressed to reduce the vibration. To suppress the resonance in the vibration mode, the natural frequency of the gearbox 10 should be made higher than the rotational speed of the compressor main body 4.

Figure 7:
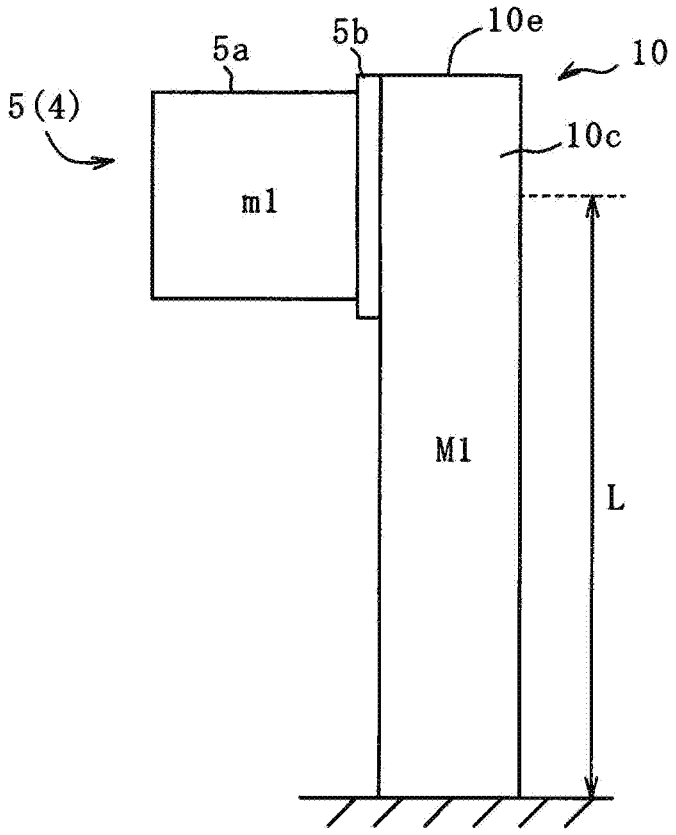
FIG. 7 is a side view showing a conventional positional relationship between a compressor main body and a gearbox.
Figure 8:
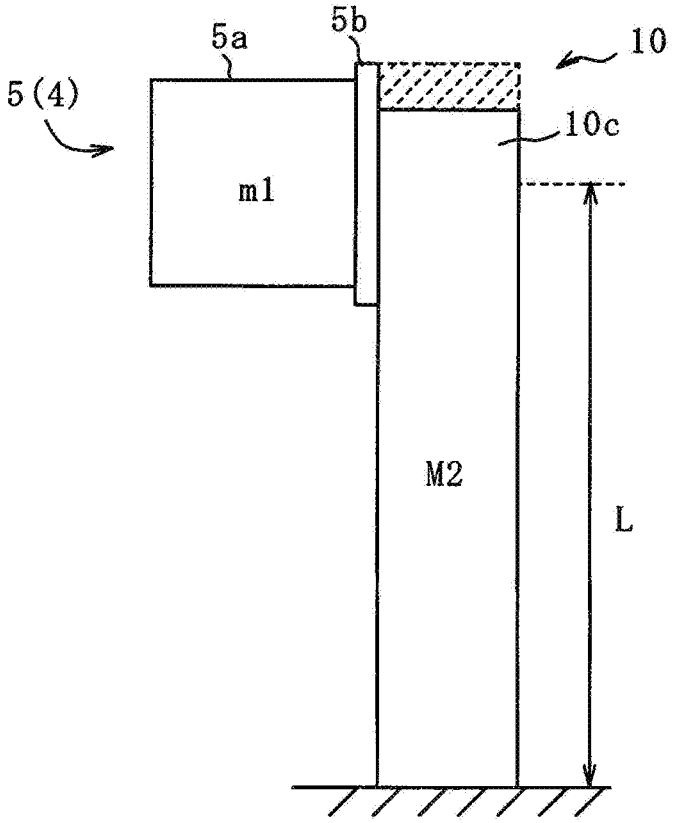
FIG. 8 is a side view showing the positional relationship between the compressor main body and the gearbox in the present invention.

With the configuration shown in FIG. 6, the natural frequency of the gearbox with the compressor main body attached in the vibration mode can be made higher than the rotational speed of the compressor main body 4 in the vibration mode of generating vibrations in the thickness direction of the gearbox 10. Thus, the resonance between the compressor main body 4 and the gearbox 10 can be suppressed without any additional component to reduce vibrations of the screw compressor. To explain this in detail, a difference between the present invention and the conventional invention will be confirmed below with reference to FIGS. 7 and 8. FIGS. 7 and 8 omit the illustration of the motor 8.

The difference between both cases shown in FIGS. 7 and 8 is the attachment position of the compressor main body 4 onto the gearbox 10. In the conventional screw compressor 2 shown in FIG. 7, the first flange 5*b* is located within the attachment surface S of the gearbox 10. However, in the screw compressor 2 of the present embodiment shown in FIG. 8, the tip end part (dashed hatched part) of the gearbox 10 is removed, whereby a part of the first flange 5*b* extends to the outside of the attachment surface S.

Regarding the arrangement shown in FIGS. 7 and 8, assuming that the gearbox 10 to which the compressor main body 4 is attached is approximated as a cantilever beam having a mass body at the tip, the natural frequency ω in the vibration mode can be expressed by the following equation (1).

[Formula 1]

$$\omega = \sqrt{\frac{3EI}{\left(m + \frac{33}{140}M\right)L^3}} \quad (1)$$

where

ω: natural frequency m: mass of the compressor main body (mass body)

M: mass of the gearbox (beam)

E: Young's modulus of the gearbox (beam)

L: length of the gearbox (beam)

I: area moment of inertia of gearbox (beam)

In the case of a cantilever beam, the contribution to the stiffness is significant at the fixed end part and becomes smaller as being farther away from the fixed end. That is, the contribution to the rigidity is the lowest at the tip end side of the cantilever beam. In contrast, the contribution to the mass is the highest at the tip end side, while being lower at the fixed end side. For this reason, in order to increase the natural frequency ω by decreasing the mass without reducing the rigidity, it is effective to reduce the mass of the tip end side, which contributes little to the rigidity. Although the length of the beam is preferably short, the positions of drive systems, such as the motor 8 and the gears 10*f* to 10*h*, are restricted in the screw compressor 2 in many cases, and further the installation position of the compressor main body 4 cannot be changed. Consequently, the length L of the beam (gearbox 10) cannot be changed significantly. Therefore, it is effective to remove the tip end of the gearbox 10, thereby reducing the mass M of the gearbox 10 from the mass M1 to the mass M2. This makes it possible to effectively reduce the mass on the tip end side of the cantilever beam with little reduction in its rigidity. When applying to the formula (1), the mass M of the gearbox 10 can be reduced without significantly changing the Young's modulus E and the area moment of inertia, thereby making it possible to increase the natural frequency ω.

In the specific configuration of the present embodiment, the tip end (upper) part of the gearbox 10 is removed to extend a part of the first flange 5*b* to the outside of the attachment surface S, thereby decreasing the mass of the tip end part of the gearbox 10, thus increasing the natural frequency in the vibration mode. However, in the configuration in which a part of the first flange 5*b* is extended to the outside of the attachment surface S of the gearbox 10, if an extension amount of the part is set extremely large in order to decrease the mass of the tip end part of the gearbox 10, the rigidity of a connection portion between the compressor main body 4 and the gearbox 10 is reduced, which would result in an increase of vibrations of the screw compressor. Thus, in the present embodiment, the extension amount is limited so that the projection regions of the rotor casings 5*e* and 6*e* on the attachment surface S exist in the attachment surface S, whereby the rigidity of the connection portion between the compressor main body 4 and the gearbox 10 is maintained at a certain level or more. In particular, since the first flange 5*b* in the main body casings 5*a* and 6*a* of the compressor main body 4 is integrated with the gearbox 10 in the above-mentioned range of the extension amount, the effect of enhancing the rigidity of the connection portion can be obtained as if the thickness of the first flange 6*b* were increased. Therefore, the rigidity of the connection portion does not need to be enhanced only by the main body casings 5*a* and 6*a*.

As shown in FIG. 6, in the present embodiment, a part of a projection region, onto the attachment surface S, of the side wall 5*m* (see FIG. 4) of the main body casing 5*a* in the low-pressure stage compressor main body 5 exists outside the attachment surface S (hatched region A3).

The low-pressure stage compressor main body 5 has a larger mass than the high-pressure stage compressor main body 6, so that in the gearbox 10, the natural frequency of the attachment portion of the low-pressure stage compressor main body 5 is lower than the natural frequency of the attachment portion of the high-pressure stage compressor main body 6. Because of this, the low-pressure stage compressor main body 5 is more likely to resonate than the high-pressure stage compressor main body 6. Therefore, in the attachment portion of the low-pressure stage compressor main body 5, increasing the natural frequency by decreasing the mass of the tip end part of the gearbox 10 is effective for suppressing the resonance between the compressor main body and the gearbox to reduce vibrations. The part of the projection region of the side wall 5*m* of the main body casing 5*a* onto the attachment surface S exists outside the attachment surface (hatched region A3), so that the mass of the tip end part of the gearbox 10 can be further decreased to increase the natural frequency in the vibration mode.

Figure 9:
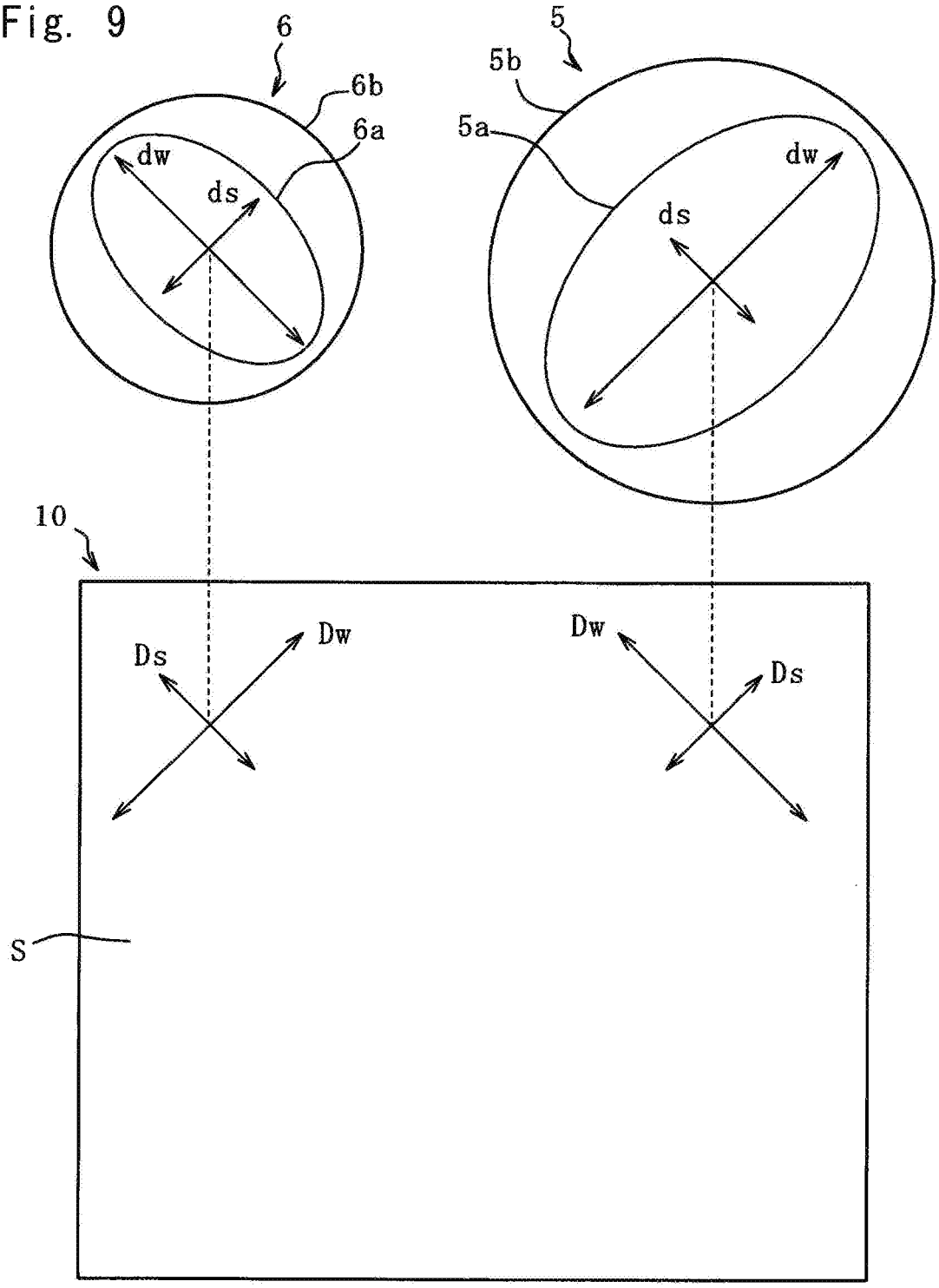
FIG. 9 is a schematic view showing the positional relationship between the strong axes and the weak axes of the compressor main body and gearbox.

Referring to FIG. 9, an attachment angle at which the compressor main body 4 is attached to the gearbox 10 will be described below. FIG. 9 is an exploded view of the compressor main body 4 separated from the gearbox 10 in a state where the attachment angle is maintained in the front view. The compressor main body 4 is preferably disposed at the gearbox 10 such that the strong axis direction ds of each of the main body casings 5*a* and 6*a* falls within a range of −45 degrees to +45 degrees relative to the weak axis direction Dw of the gearbox 10 against the vibration. More preferably, as shown in FIG. 9, the compressor main body may be fixed to the gearbox 10 with the positional relationship in which the strong axis direction ds of each of the main body casings 5*a* and 6*a* completely coincides with the weak axis direction Dw of the gearbox 10. Here, the strong axes Ds and ds and the weak axes Dw and ds are defined as directions perpendicular to the thickness direction of the gearbox 10 at which vibrations should be considered. The strong axes Ds and ds are the main axes on which the area moment of inertia is at the maximum, and the weak axes Dw and dw are the main axes on which the area moment of inertia is at the minimum. At this time, the directions of the strong axes Ds and ds correspond to the directions in which vibration is more likely to occur, and the directions of the weak axes Dw and dw correspond to the directions in which vibrations are less likely to occur.

By arranging the main body casings 5*a* and 6*a* with respect to the gearbox 10 such that the strong axis direction ds of each of the main body casings 5*a* and 6*a* overlaps with the weak axis direction Dw of the gearbox 10 within the range of −45 degrees to +45 degrees, the rigidity of the main body casings 5*a* and 6*a* and the gearbox 10 as an integrated structure can be effectively increased. That is, the main body casings 5*a* and 6*a* are disposed with respect to the gearbox 10 such that the direction in which the main body casings 5*a* and 6*a* are less likely to vibrate overlaps with the direction in which the gearbox 10 is more likely to vibrate, thereby making it possible to reduce vibrations of the integrated structure.

Figure 10:
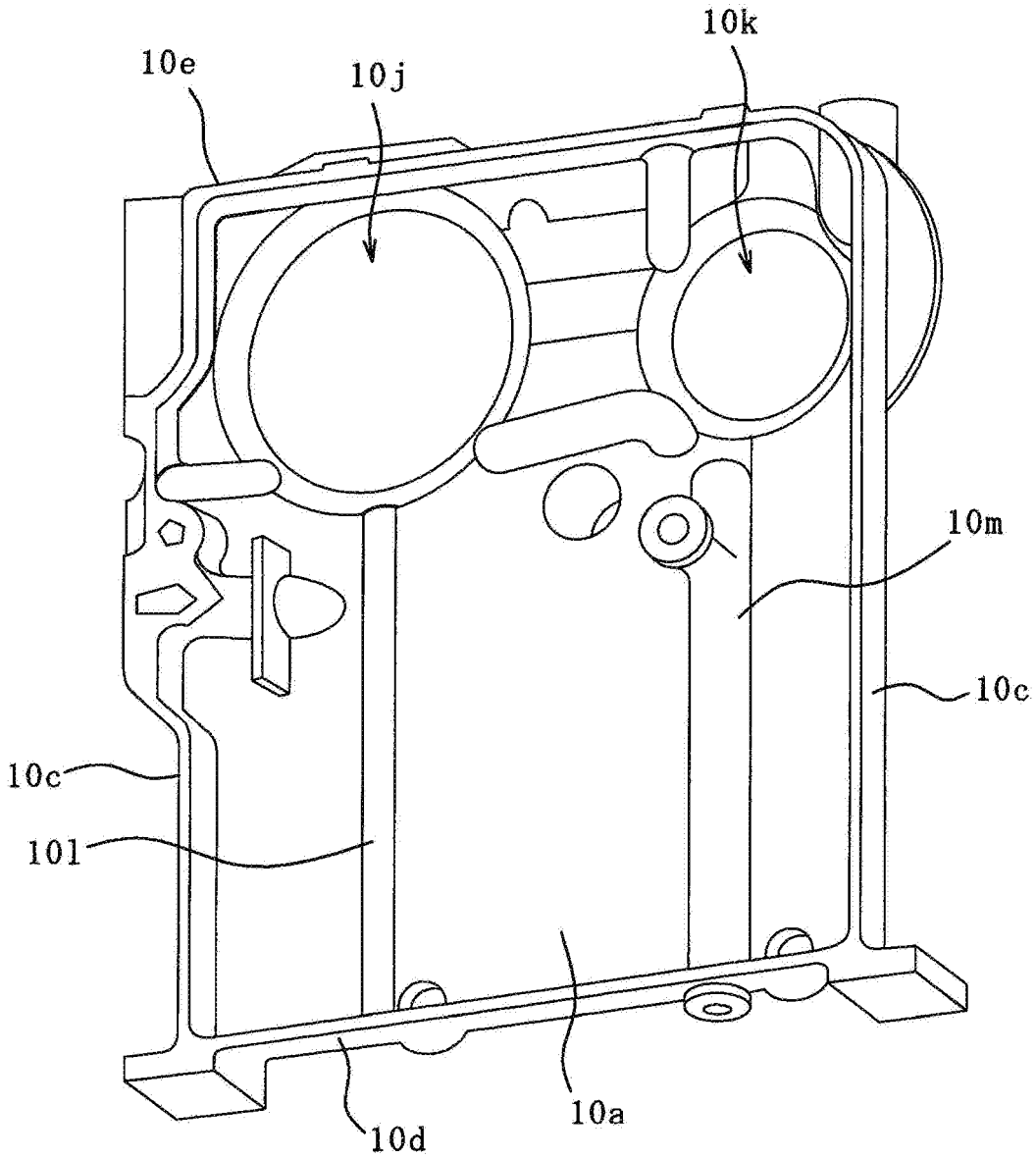
FIG. 10 is a perspective view showing an inner surface of a front plate in the gearbox shown in FIG. 1.

Referring to FIG. 10, the inner surface shape of the front plate 10*a* of the gearbox 10 will be described below. The front plate 10*a* of the gearbox 10 is substantially rectangular and is provided with two circular attachment holes 10*j* and

10*k* for attaching the low-pressure stage compressor main body 5 and the high-pressure stage compressor main body 6 in the vicinity of both corners on the upper side of the front plate, respectively. A stiffening rib 101 is provided at the inner surface of the gearbox 10 in the longitudinal direction (vertical direction) within the attachment surface S. The stiffening rib 101 has a convex shape on the inner surface of the front plate 10*a*, and is provided to extend from a lower end of the front plate 10*a* in the gearbox 10 to the attachment hole 10*j* in the vertical direction and to be within the range of the attachment hole 10*j* in the horizontal direction. In particular, when the gearbox 10 is rectangular, the rigidity of the gearbox 10 in the longitudinal direction is relatively low. Because of this, reinforcement of the gearbox 10 by providing the stiffening ribs 101 in the longitudinal direction is effective for increasing the rigidity of the gearbox 10. Thus, the rigidity of the gearbox 10 in the vibration mode can be effectively enhanced. To further enhance the rigidity, the stiffening rib 101 may connect the front plate 10*a* and the rear plate 10*b* together.

The front plate 10*a* of the gearbox 10 is provided with an embedded oil pipe 10*m* in the longitudinal direction within the attachment surface S. In the gearbox 10, lubricating oil needs to be supplied to meshing parts between a bull gear 10*f* and pinion gears 10*g* and 10*h*, the bearings 5*h* to 5*k* and 6*h* to 6*k* that support the rotating shafts 5*f*, 5*g*, 6*f* and 6*g* of the screw rotors 5*c*, 5*d*, 6*c* and 6*d* and the motor rotary shaft 8*a*.

With this configuration, like the above-mentioned stiffening rib 101, the embedded oil pipe 10*m* can be utilized for stiffening. Further, the oil pipe 10*m* can be used to supply the lubricating oil to each site required in the compressor main body 4. Especially, the embedded oil pipe eliminates the need to perform a piping operation at the time of assembly, and makes it possible to suppress oil leakage at connection locations of the piping.

Second Embodiment

Figure 11:
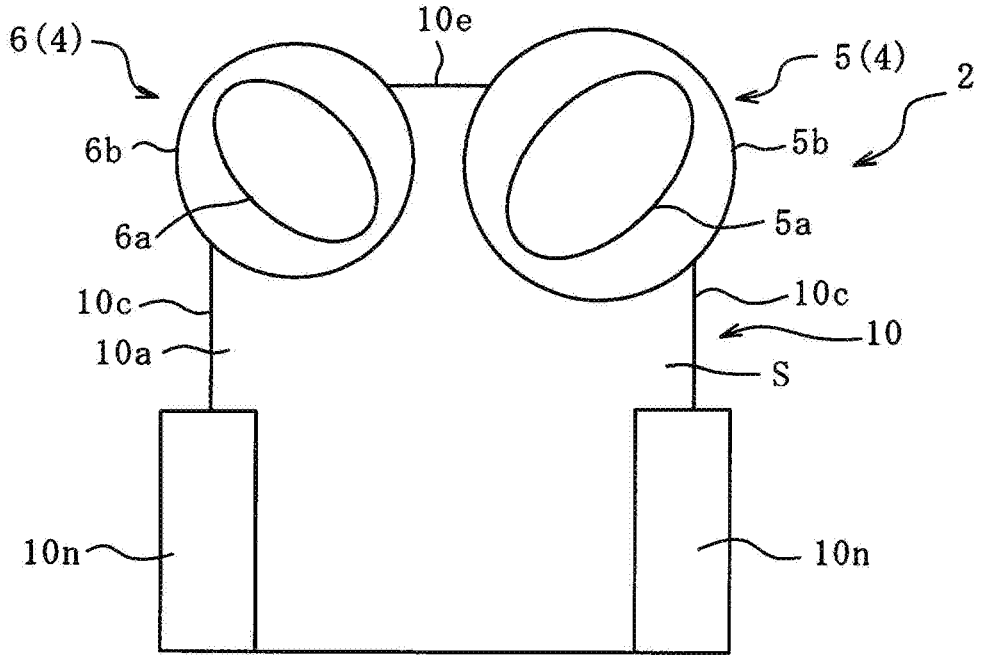
FIG. 11 is a front view of a screw compressor according to a second embodiment of the present invention.
Figure 12:
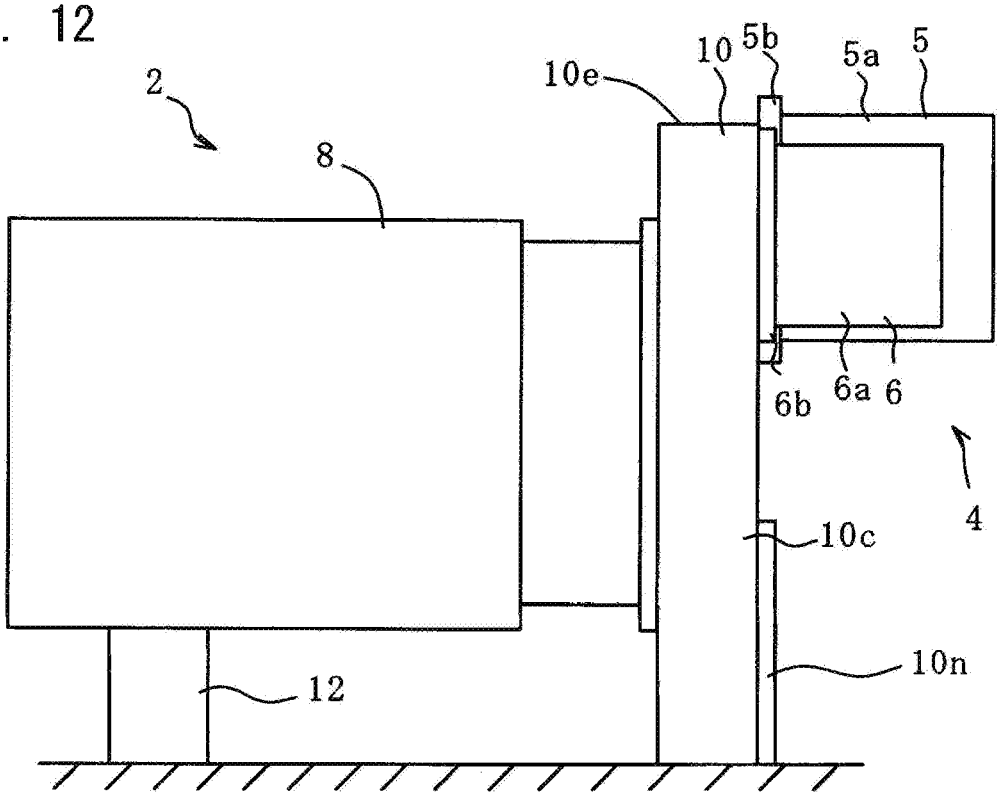
FIG. 12 is a side view of the screw compressor shown in FIG. 11.

In a screw compressor 2 of the second embodiment shown in FIGS. 11 and 12, second flanges 10*n* are provided at the attachment surface S of the gearbox 10. The present embodiment is substantially the same as the first embodiment shown in FIGS. 1 and 2 except for this point. Therefore, the description of the same parts as those mentioned in the first embodiment will be omitted.

The compressor main body 4 (low-pressure stage compressor main body 5 and high-pressure stage compressor main body 6) is connected to both corners on the upper side of the gearbox 10 within the attachment surface S, and further the gearbox 10 has the second flanges 10*n* on both corners on the lower side thereof. Each second flange 10*n* is rectangular in the front view and has a thickness that is substantially the same as the thickness of the front plate 10*a*. The second flanges 10*n* extend outward away from the gearbox 10 in the horizontal direction on the attachment surface S of the front plate 10*a*. By providing the second flanges 10*n* on the attachment surface S of the gearbox 10, the thickness of the front plate 10*a* is increased, so that the rigidity of the gearbox 10 against the vibration mode can be further improved.

Figure 13:
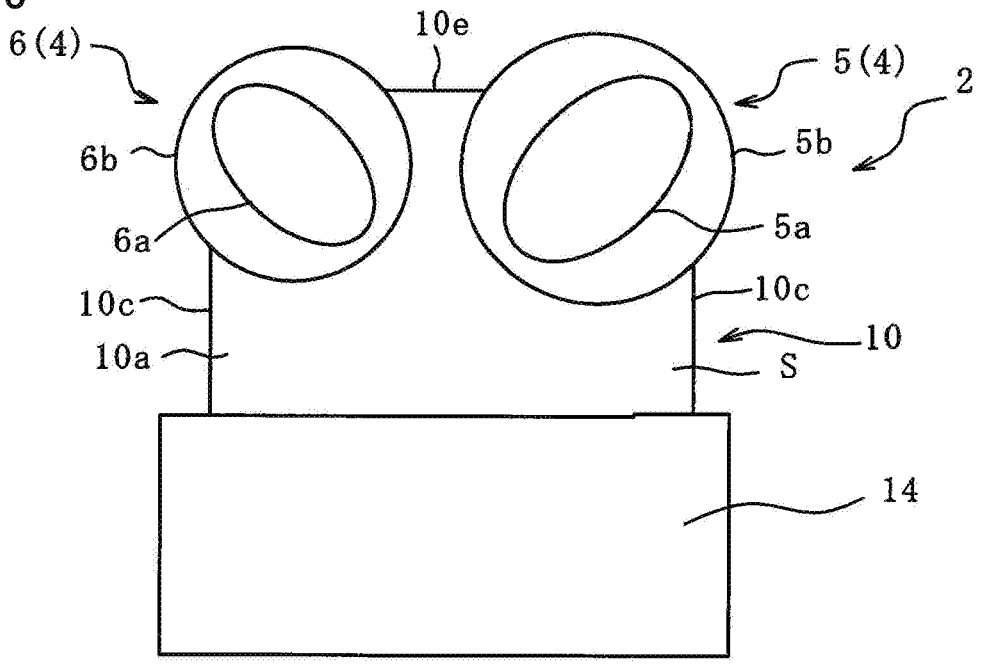
FIG. 13 is a front view showing a modified example of the screw compressor shown in FIG. 11.
Figure 14:
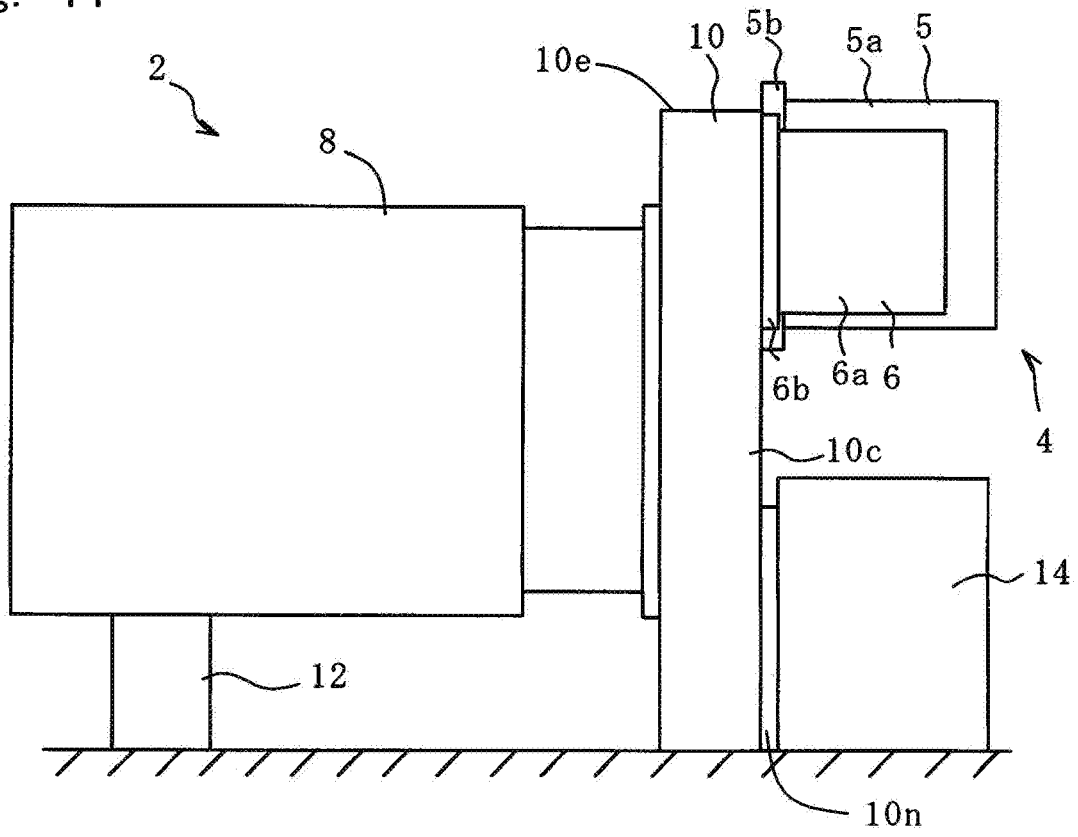
FIG. 14 is a side view of the screw compressor shown in FIG. 13.

A modified example of the second embodiment will be described with reference to FIGS. 13 and 14. In the present modified example, the gearbox 10 is connected to a separate cooler (structure) 14 at the second flange 10*n*. This configuration eliminates the need to separately support the gearbox 10 and the cooler 14, and can further improve the rigidity of the gearbox 10 in the vibration mode. In addition, the cooler 14 is a pressure vessel and hence has a high rigidity. Owing to this, when the cooler 14 is attached to the gearbox 10, the rigidity of the gearbox in the vicinity of the attachment position of the cooler 14 becomes relatively high, compared to the rigidity of the gearbox in the vicinity of the attachment position of the compressor main body 4 other than the cooler 4. As a result, the attachment part of the cooler 14 acts as a fixed end, thereby making it possible to obtain the effect of increasing the natural frequency as if the axial length of the cantilever beam were shortened.

The invention claimed is:

1. A screw compressor, comprising:

a compressor main body being of a two stage type including a low-pressure stage compressor main body which includes screw rotors, a rotor casing accommodating therein the screw rotors, and a main body casing accommodating therein the rotor casing, the main body casing having a first flange provided on an end thereof;

an electric motor for driving the screw rotors via a gear; and a gearbox, which has a rectangle shape, accommodating therein the gear, having an attachment surface on which the first flange of the main body casing is attached, wherein in a state where the main body casing of the low-pressure stage compressor main body is attached to the gearbox, a part of the first flange extends to an outside of the attachment surface, and a projection region of the rotor casing in its entirety exists within the attachment surface where the projection region of the rotor casing is a region projected in a direction vertical to the attachment surface, and wherein the compressor main body is disposed at the gearbox such that a strong axis direction of the main body casing against vibration is within a range from −45 degrees to +45 degrees with respect to a weak axis direction of the gearbox against the vibration.

2. The screw compressor according to claim 1, wherein the compressor main body includes the low-pressure stage compressor main body and a high-pressure stage compressor main body for further compressing gas compressed by the low-pressure stage compressor main body, and wherein a part of a projection region of a side wall of the main body casing of the low-pressure stage compressor main body onto the attachment surface exists outside the attachment surface.

3. The screw compressor according to claim 2, wherein the gearbox is provided with a stiffening rib extended in a longitudinal direction thereof within the attachment surface.

4. The screw compressor according to claim 2, wherein the gearbox is provided with an embedded oil pipe extended in a longitudinal direction thereof within the attachment surface.

5. The screw compressor according to claim 2, wherein the gearbox has upper side corners to which the compressor main body is connected so as to be within the attachment surface, and lower side corners with second flanges.

6. The screw compressor according to claim 5, wherein the gearbox is connected to a separate structure at the second flanges.

7. The screw compressor according to claim 1, wherein the gearbox is provided with a stiffening rib extended in a longitudinal direction thereof within the attachment surface.

8. The screw compressor according to claim 1, wherein the gearbox is provided with an embedded oil pipe extended in a longitudinal direction thereof within the attachment surface.

9. The screw compressor according to claim 1, wherein the gearbox has upper side corners to which the compressor main body is connected so as to be within the attachment surface, and lower side corners with second flanges.

10. The screw compressor according to claim 9, wherein the gearbox is connected to a separate structure at the second flanges.

11. A screw compressor, comprising:

a compressor main body including screw rotors, a rotor casing accommodating therein the screw rotors, and a main body casing accommodating therein the rotor casing, the main body casing having a first flange provided on an end thereof;

an electric motor for driving the screw rotors via a gear; and a gearbox, which has a rectangle shape, accommodating therein the gear, having an attachment surface on which the first flange of the main body casing is attached, wherein in a state where the main body casing is attached to the gearbox, a part of the first flange extends to an outside of the attachment surface, and a projection region of the rotor casing in its entirety exists within the attachment surface where the projection region of the rotor casing is a region projected in a direction vertical to the attachment surface, and wherein the compressor main body is disposed at the gearbox such that a strong axis direction of the main body casing against vibration is within a range from −45 degrees to +45 degrees with respect to a weak axis direction of the gearbox against the vibration.

12. A screw compressor, comprising: a compressor main body including screw rotors, a rotor casing accommodating therein the screw rotors, and a main body casing accommodating therein the rotor casing, the main body casing having a first flange provided on an end thereof; an electric motor for driving the screw rotors via a gear; and a gearbox, which has a rectangle shape, accommodating therein the gear, having an attachment surface on which the first flange of the main body casing is attached, wherein in a state where the main body casing is attached to the gearbox, a part of the first flange extends to an outside of the attachment surface, and a projection region of the rotor casing in its entirety exists within the attachment surface where the projection region of the rotor casing is a region projected in a direction vertical to the attachment surface, wherein the compressor main body includes a low-pressure stage compressor main body and a high-pressure stage compressor main body for further compressing gas compressed by the low-pressure stage compressor main body; wherein a part of a projection region of a side wall of a main body casing of the low-pressure stage compressor main body onto the attachment surface exists outside the attachment surface; and wherein the compressor main body is disposed at the gearbox such that a strong axis direction of the main body casing of the low-pressure stage compressor main body against vibration is within a range from −45 degrees to +45 degrees with respect to a weak axis direction of the gearbox against the vibration.

* * * * *